US008627751B2

(12) United States Patent
Parkin

(10) Patent No.: US 8,627,751 B2
(45) Date of Patent: Jan. 14, 2014

(54) DEVICE FOR LOOSENING AND UNTYING KNOTS

(76) Inventor: Leonard Paul Parkin, Middlesex, NJ (US)

( * ) Notice: Subject to any disclaimer, the term of this patent is extended or adjusted under 35 U.S.C. 154(b) by 114 days.

(21) Appl. No.: 13/495,473

(22) Filed: Jun. 13, 2012

(65) Prior Publication Data

US 2012/0318109 A1 Dec. 20, 2012

Related U.S. Application Data

(60) Provisional application No. 61/497,674, filed on Jun. 16, 2011.

(51) Int. Cl.
*B25B 27/14* (2006.01)

(52) U.S. Cl.
USPC ..... 81/485; 81/443; 81/453; 81/455; 254/104; 29/261; 606/142

(58) Field of Classification Search
USPC ..... 81/3.7, 9.3, 485, 486, 483, 443, 444, 81/453–455; 29/225–230; 269/6, 3, 95; 254/93 R, 100, 134, 133 R
See application file for complete search history.

(56) References Cited

U.S. PATENT DOCUMENTS

| | | | | | |
|---|---|---|---|---|---|
| 1,407,719 | A | * | 2/1922 | Boner | 254/104 |
| 1,544,903 | A | * | 7/1925 | Heely | 81/485 |
| 2,302,691 | A | * | 11/1942 | Green | 81/453 |
| 2,303,560 | A | * | 12/1942 | Knight | 29/261 |
| 2,444,287 | A | * | 6/1948 | Ettinger | 81/455 |
| 2,553,479 | A | * | 5/1951 | Schmarje et al. | 81/443 |
| 2,556,395 | A | * | 6/1951 | MacLean | 81/443 |
| 2,737,988 | A | * | 3/1956 | Gearhart et al. | 81/438 |
| 2,840,082 | A | * | 6/1958 | Salvatore | 606/140 |
| 3,518,993 | A | * | 7/1970 | Blake | 606/142 |
| 3,749,365 | A | * | 7/1973 | Van Gompel | 254/104 |
| 3,855,996 | A | * | 12/1974 | Bolduc | 128/831 |
| 4,007,535 | A | * | 2/1977 | Brandt et al. | 29/261 |
| 5,159,743 | A | * | 11/1992 | Somerville | 29/252 |
| 5,311,798 | A | * | 5/1994 | Trusky | 81/485 |
| 5,355,752 | A | * | 10/1994 | Keenan et al. | 81/453 |
| 5,571,180 | A | | 11/1996 | Blom | |

(Continued)

OTHER PUBLICATIONS

International Search Report and Written Opinion issued in connection with International Patent application PCT/US2012/042195 "Device for Loosening and Untying Knots" filed Jun. 13, 2012.

*Primary Examiner* — Monica Carter
*Assistant Examiner* — Melanie Alexander
(74) *Attorney, Agent, or Firm* — Greenberg Traurig, LLP

(57) ABSTRACT

A device for loosening and untying knots including a body having a first section and a second section having a plurality of channels, a pusher rod positioned slidably within the first section of the body, a shaft positioned slidably within the first and second sections of the body and being engaged with the rod, and a plurality of prongs, each including a base, a nose and a rail. The rails slidably fit into the channels of the body, and a head of the shaft is engaged with the bases of the prongs. The prongs move between a retracted position, in which the noses are juxtaposed with one another and inserted within a knot, and an expanded position, in which the noses are spaced apart from one another when the shaft is moved within the body, the noses loosen and untie the knot when the prongs are expanded.

16 Claims, 8 Drawing Sheets

(56) References Cited

U.S. PATENT DOCUMENTS

| | | | | |
|---|---|---|---|---|
| 5,575,643 | A * | 11/1996 | Green | 433/3 |
| D385,009 | S | 10/1997 | Adams et al. | |
| 5,890,253 | A | 4/1999 | Morad | |
| 5,928,251 | A * | 7/1999 | Aranyi et al. | 606/142 |
| 6,511,488 | B1 | 1/2003 | Marshall et al. | |
| 6,665,919 | B1 * | 12/2003 | Kurtz et al. | 29/262 |
| 7,272,907 | B1 | 9/2007 | Andrews | |
| 7,398,956 | B2 | 7/2008 | Clark et al. | |
| 8,409,219 | B2 * | 4/2013 | Kelley et al. | 606/129 |
| 2005/0278865 | A1 | 12/2005 | West | |
| 2006/0096610 | A1 | 5/2006 | Bradford et al. | |
| 2006/0266397 | A1 | 11/2006 | Berl | |
| 2009/0205221 | A1 | 8/2009 | Mitchell | |

* cited by examiner

DEVICE FOR LOOSENING AND UNTYING KNOTS

CROSS-REFERENCES TO RELATED APPLICATION

This application is a Section 111(a) application relating to and claims the benefit of U.S. Provisional Patent Application Ser. No. 61/497,674, filed on Jun. 16, 2011, entitled "A TOOL FOR UNTYING KNOTS," the disclosure of which is incorporated herein by reference in its entirety.

FIELD OF THE INVENTION

The present invention relates to a device for loosening and untying knots, and, more particularly, to a hand tool for loosening and untying knots in shoe laces, lines and ropes.

BACKGROUND OF THE INVENTION

Over the ages, people have been plagued with the problem of loosening and untying knots that have become hard-tied in shoe lacings. For instance, shoe lacings when tied in a bow-knot are very liable to become untied and become an inconvenience and annoyance to the wearer, and when tied in a hard knot, it is very difficult to untie the knot. Often times, people will employ forks or other implements that are not specifically designed for loosening and untying knots. Such usage is unsafe and can damage the implement as well as the shoelace. What is needed is a device that can loosen and untie hard-tied knots easily by the wearer.

SUMMARY OF THE INVENTION

In an embodiment, a device for loosening and untying knots, comprising a body including a front end and a rear end opposite the front end, a first section including a bore, and a second section including a bore and an outer surface, the outer surface of the second section including a plurality of channels formed therein; a pusher rod positioned slidably within the bore of the first section of the body; a shaft having a first end and a second end opposite the first end, and a head formed at the second end, the shaft being positioned slidably within the bore of the first section of the body and the bore of the second section of the body, the first end of the shaft being engaged with the pusher rod, the shaft being moveable between a retracted position and an engaged position in response to inward movement of the pusher rod within the body; and a plurality of prongs, each of which includes a base having a front surface, a rear surface opposite the front surface, a nose extending outwardly from the front surface, and a rail extending outwardly from the rear surface, each of the rails of the plurality of prongs being sized and shaped to slidably fit into a corresponding one of the plurality of channels of the second section of the body, the head of the shaft being engaged with the bases of the plurality of prongs, wherein the plurality of prongs is moveable between a retracted position, in which the noses of the plurality of prongs are juxtaposed with one another and adapted to being inserted within a knot, and an expanded position, in which the noses are spaced apart from one another when the shaft is moved to its engaged position, the noses of the plurality of prongs being adapted to loosen and untie the knot when the plurality of prongs is in its expanded position. In an embodiment, the second section of the body is frusta-conical in shape.

In an embodiment, the head of the shaft includes a front surface having a plurality of rails extending outwardly therefrom, and each of the plurality of prongs includes a slot formed within the base thereof, and wherein each of the slots of the plurality of prongs is sized and shaped to slidably receive a corresponding one of the plurality of rails of the head of the shaft.

In an embodiment, each of the plurality of channels of the body includes a T-shaped cross-section, each of the rails of the plurality of prongs includes a T-shaped cross-section, each of the plurality of rails of the head of the shaft includes a T-shaped cross-section, and each of the slots of the plurality of prongs includes a T-shaped cross-section.

In an embodiment, the rear surface of the base of each of the plurality of prongs is beveled. In an embodiment, the nose of each of the plurality of prongs includes an angled beak. In an embodiment, the second section of the body includes a depression formed proximate to the front end of the body, the depression including a surface, and the head of the shaft includes a rear surface opposite the front surface of the head, the rear surface of the head bears against the surface of the depression when the shaft is in its retracted position.

In an embodiment, a spring housed within the bore of the first section of the body and around the shaft, and wherein the spring includes a first end engaged with the pusher rod, the spring biases the shaft from its engaged position to its retracted position.

In an embodiment, the pusher rod includes a bore having internal threads, and the first end of the shaft includes external threads that threadedly engage the internal threads of the pusher rod.

In an embodiment, the plurality of prongs includes four prongs, the plurality of channels of the second section of the body includes four channels, and the plurality of rails of the head of the shaft includes four rails. In an embodiment, the rails of the head of the shaft are positioned in a cross-shaped array. In an embodiment, the body includes a longitudinal axis, and wherein each of the channels of the second section of the body extends at an angle relative to the longitudinal axis. In an embodiment, the angle is in a range of about 5 degrees to about 25 degrees.

In an embodiment, the pusher rod includes a hand grip. In an embodiment, the body includes a flange positioned proximate to the rear end thereof. In an embodiment, the plurality of prongs move in synchronization with one another when moved between its retracted position and expanded position.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE EXEMPLARY EMBODIMENT

Although the present invention can be used in conjunction with any type of knot, it is particularly suitable for use in connection with a shoelace knot. Accordingly, the present invention will be described hereinafter in connection with such a shoelace knot. It should be understood, however, that the following description is only meant to be illustrative of the present invention and is not meant to limit the scope of the present invention, which has applicability to other types of knots such as boating-line knots, jewelry-chain knots, or any other knots.

Figure 6:
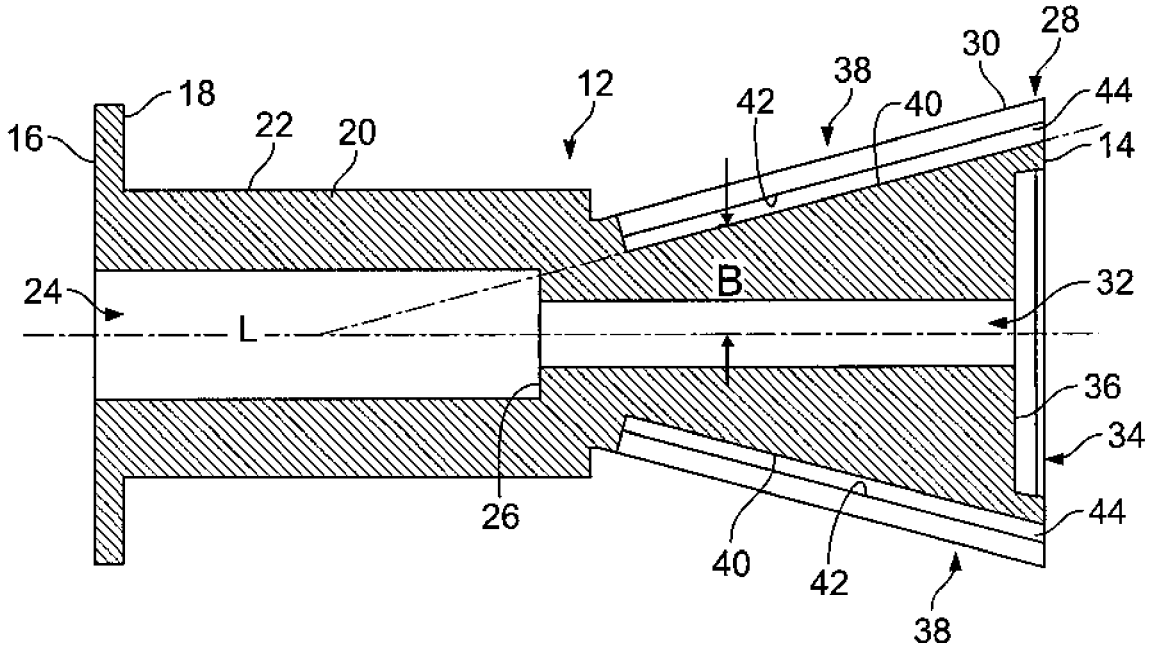
FIG. 6 is a cross-sectional view of a body shown in FIG. 4, taken along the section-line 6-6 and looking in the direction of the arrows.
Figure 7:
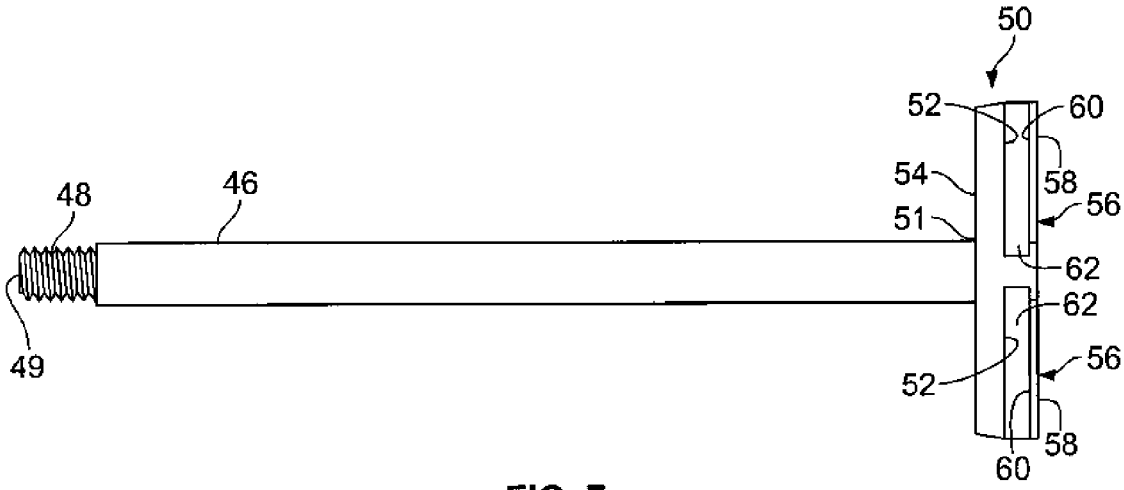
FIG. 7 is a side view of a shaft with a disc-shaped head employed by the device shown in FIGS. 1-4.
Figure 8:
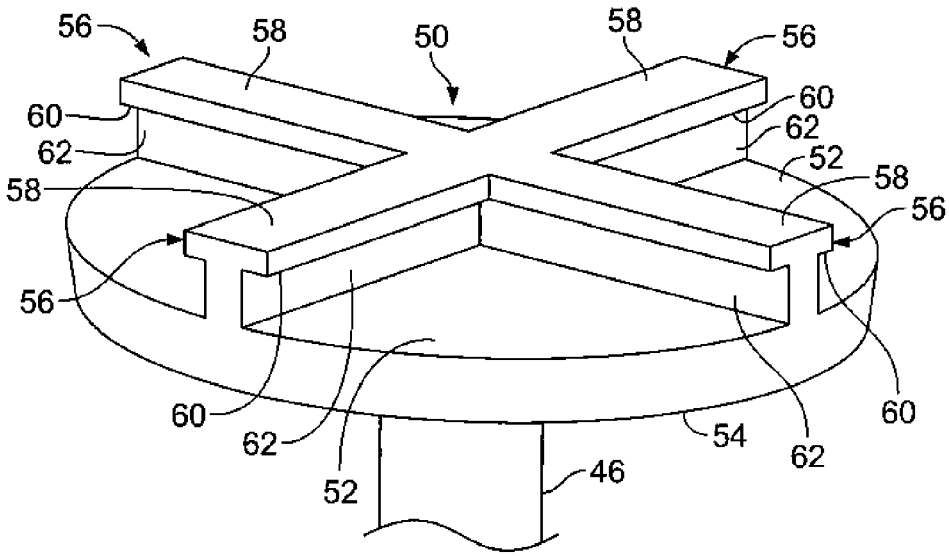
FIG. 8 is partial-perspective view of the shaft with the disc-shaped head shown in FIG. 7.

FIGS. 1-4 illustrate a device for loosening and untying knots 10 (hereinafter "the device 10") constructed in accordance with an embodiment of the present invention. In an embodiment, the device 10 includes an elongated body 12 that is symmetrically shaped around its longitudinal axis L (see FIG. 6). Referring to FIG. 6, the body 12 includes a front end 14 and a rear end 16 opposite the front end 14. A flange 18 is located at the rear end 16 of the body 12. The body 12 includes a first section 20 with an outer surface 22, and a bore 24 centrally positioned therein. In an embodiment, the first section 20 is cylindrical in shape. The bore 24 extends from the rear end 16 of the body 12 to a ring-shaped surface 26 located within the first section 20. The first section 20 extends longitudinally from the flange 18 towards the front end 14 of the body 12. The body 12 includes a second section 28 with an outer surface 30, and a bore 32 centrally located therein. In an embodiment, the second section 28 is frusto-conical in shape. The second section 28 extends from the first section 20 to the front end 14 of the body 12, while the outer surface 30 extends in a direction oblique to the longitudinal axis L of the body 12. The bore 32 of the second section 28 extends from the ring-shaped surface 26 to the front end 14 of the body 12. Referring back to FIG. 4, a depression 34 is centrally recessed in the second section 28 proximate to the front end 14 of the body 12. The depression 34 includes a ring-shaped surface 36 that is formed in a plane that is perpendicularly oriented to the longitudinal axis L. Four T-shaped channels 38 are symmetrically positioned in the outer surface 30 of the second section 28. The channels 38 extend from the first section 20 of the body 12 to the front end 14 of the body 12. Referring back to FIG. 6, each channel 38 includes an inner surface 40, outer surfaces 42, and side surfaces 44, the purposes of which will be described hereinbelow Referring to FIG. 7, a shaft 46 includes male threads 48 formed on one end 49 and a disc-shaped head 50 formed on an opposite end 51. The head 50 is formed in a plane which is perpendicularly oriented to the longitudinal axis L. In an embodiment, the head 50 is integrally formed with the shaft 46. Referring specifically to FIGS. 7 and 8, the head 50 includes a front surface 52 and rear surface 54 opposite the front surface 52. A cross-shaped array of four rails 56 is formed on and extends from the front surface 52 of the head 50. In an embodiment, the rails 56 are oriented 90 degrees apart from one another. In an embodiment, the cross-section of each rail 56 is T-shaped and includes a front surface 58, rear surfaces 60, and side surfaces 62, for purposes that are described hereinbelow.

Figure 5:
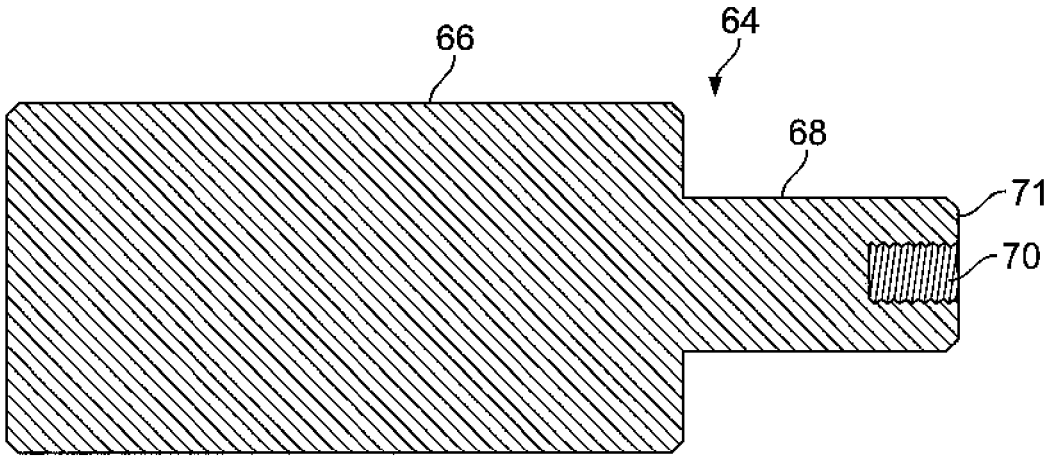
FIG. 5 is a cross-sectional view of a hand grip employed by the device shown in FIG. 4, taken along the section-line 5-5 and looking in the direction of the arrows.

FIG. 5 depicts a pusher-rod 64 including a cylindrically-shaped handgrip 66 and a cylindrically-shaped extension 68 extending outwardly from the handgrip 66. In an embodiment, the handgrip 66 includes a knurled surface (not shown) to facilitate a more stable grip of a user's hand thereon. In other embodiments, the handgrip 66 can consist of different shapes and sizes in response to ergonomic factors. For instance, in an embodiment, the handgrip 66 may be formed in the shape of a mushroom (not shown) in order to minimize pressure on the hand of the user of a large-sized device 10. In an embodiment, the extension 68 includes a diameter that is slightly smaller than the diameter of the bore 24 of the first section 20. In an embodiment, internal female threads 70 are formed within the extension 68 proximate to an end 71 thereof. In an embodiment, as shown in FIG. 3, the male threads 48 of the shaft 46 threadedly engage the female threads 70 of the extension 68 so that a small portion of the extension 68 is positioned within the bore 24 of the body 12.

Figure 1:
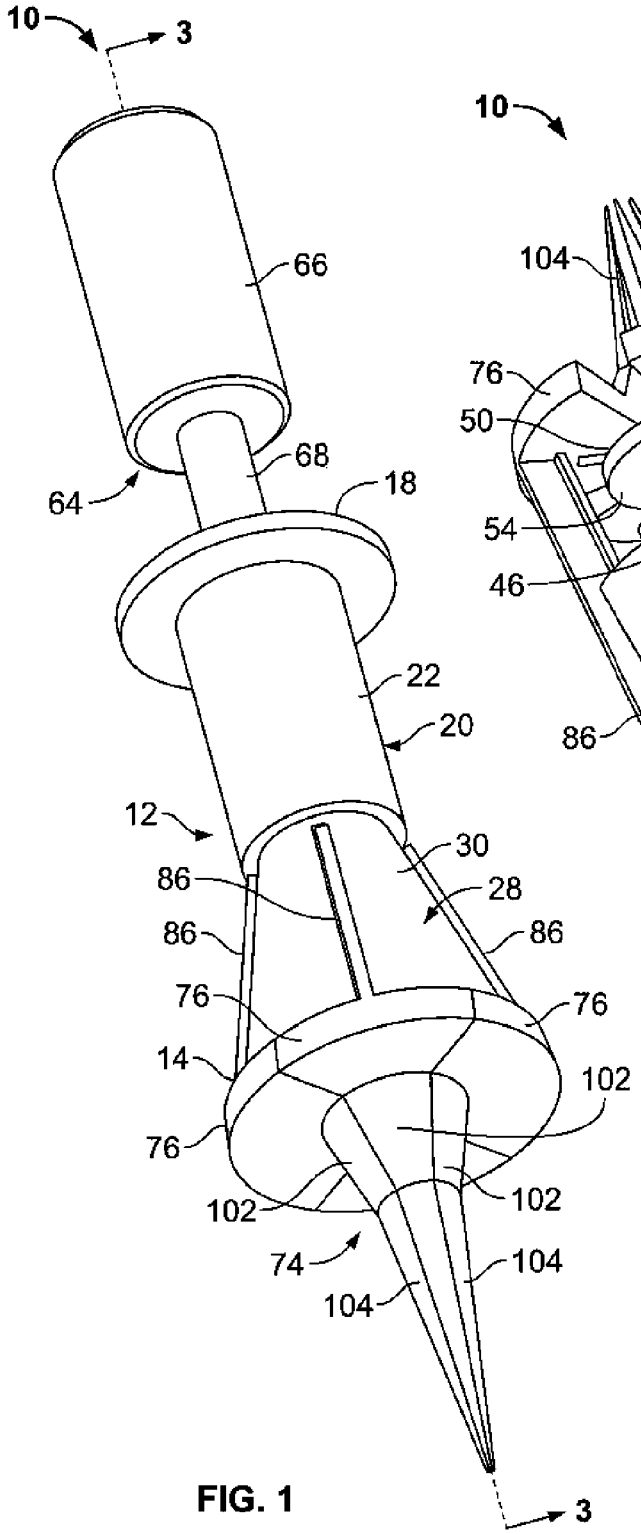
FIG. 1 is a front perspective view of a device for loosening and untying knots constructed in accordance with one embodiment of the present invention, the device being shown in a closed position.
Figure 2:
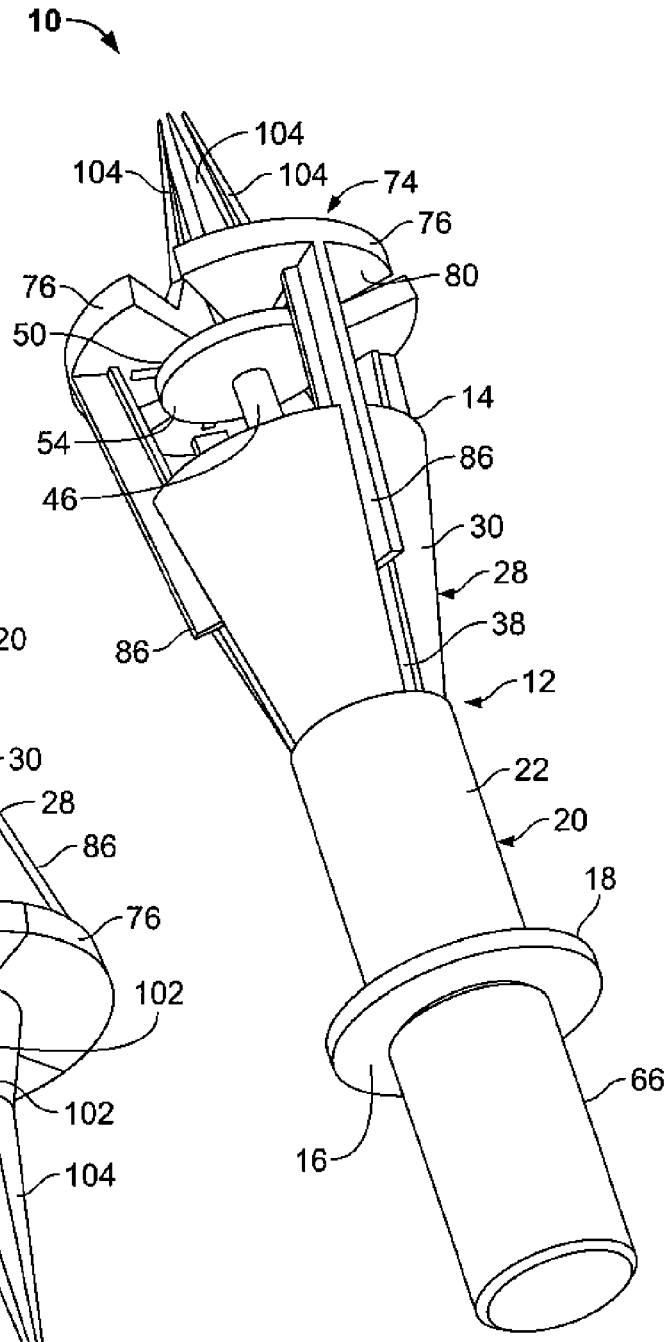
FIG. 2 is a rear perspective view of the device shown in FIG. 1, showing the device in an open position.
Figure 3:
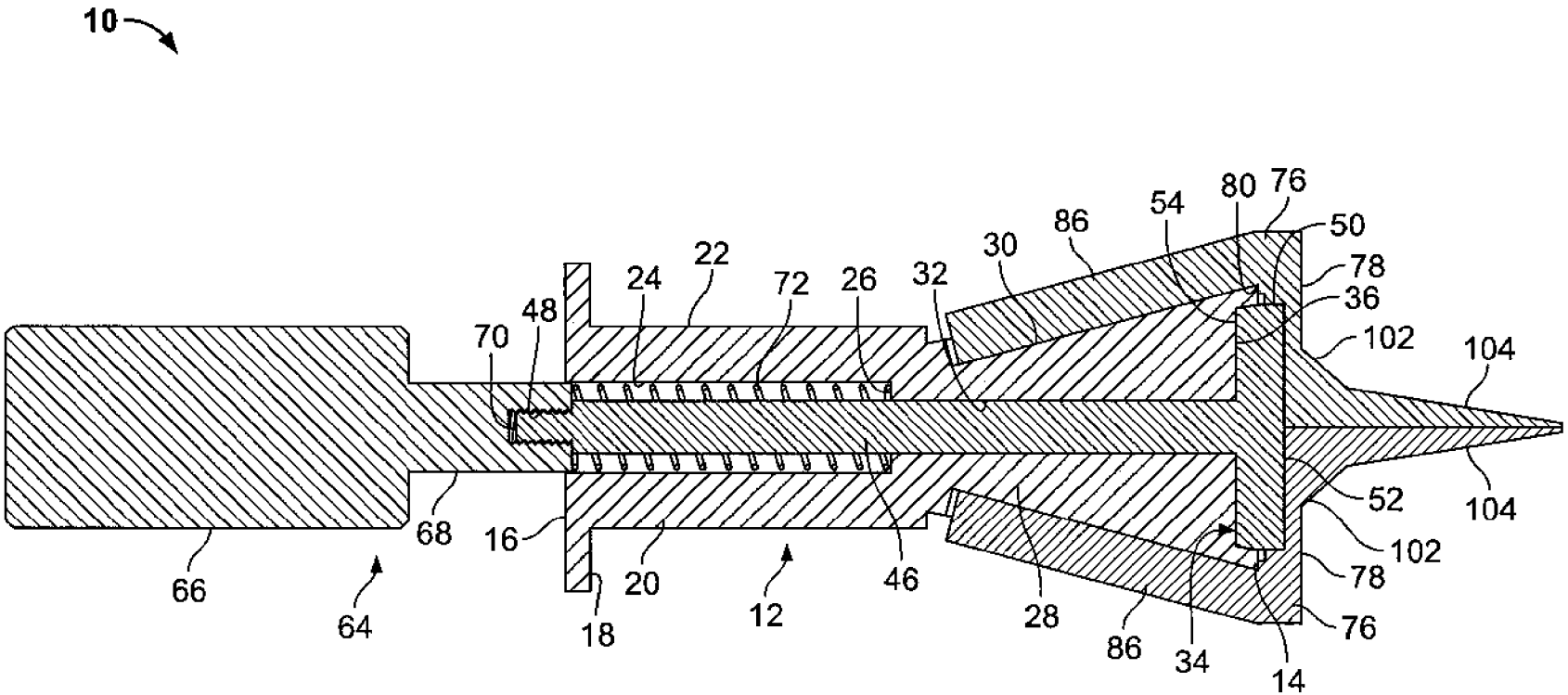
FIG. 3 is a cross-sectional view of the device shown in FIG. 1, taken along the section-line 3-3 and looking in the direction of the arrows.
Figure 4:
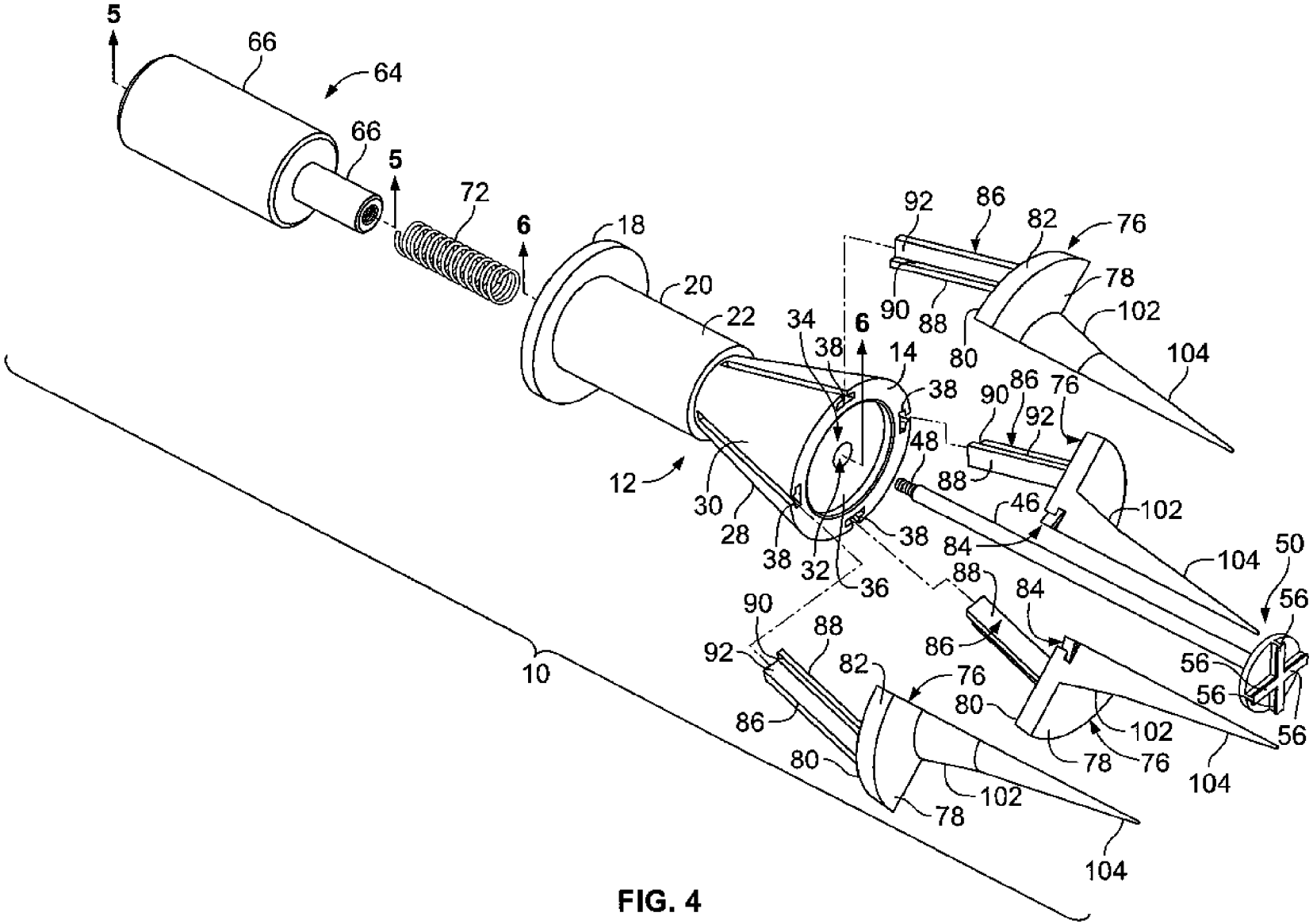
FIG. 4 is an exploded view of the device shown in FIGS. 1-3.

Referring to FIGS. 3 and 4, a coil spring 72 is located inside the bore 24 of the body and is positioned around the shaft 46. The spring 72 is compressible between the ring-shaped surface 26 and the end 71 of the extension 68, as described below. The spring 72 biases (i.e., urges) the rear surface 54 of the disc-shaped head 50 of the shaft 46 to bear on the surface 36 of the depression 34. In this configuration, a small portion of the extension 68 is constrained in the bore 24 of the body 12. As described in greater detail hereinbelow, with reference to FIG. 3, it will be understood that when pressure is applied on the handgrip 66 in the direction of the longitudinal axis L, the extension 68 is inserted in the bore 24 of the body 12 and the spring 72 becomes compressed until the handgrip 66 contacts the rear end 16 of the body 12. When pressure is released from the handgrip 66, the spring 72 biases the extension 68 out of the bore 24 until the head 50 of the shaft 46 bears on the surface 36 of the depression 34, at which point a small portion of the extension 68 is constrained in the bore 24 of the body 12.

Figure 9:
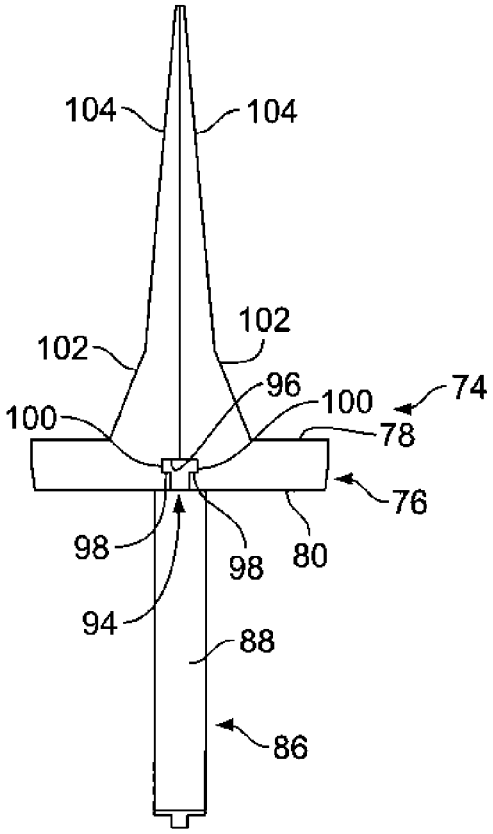
FIG. 9 is a side view of a prong employed by the device shown in FIGS. 1-4.
Figure 10:
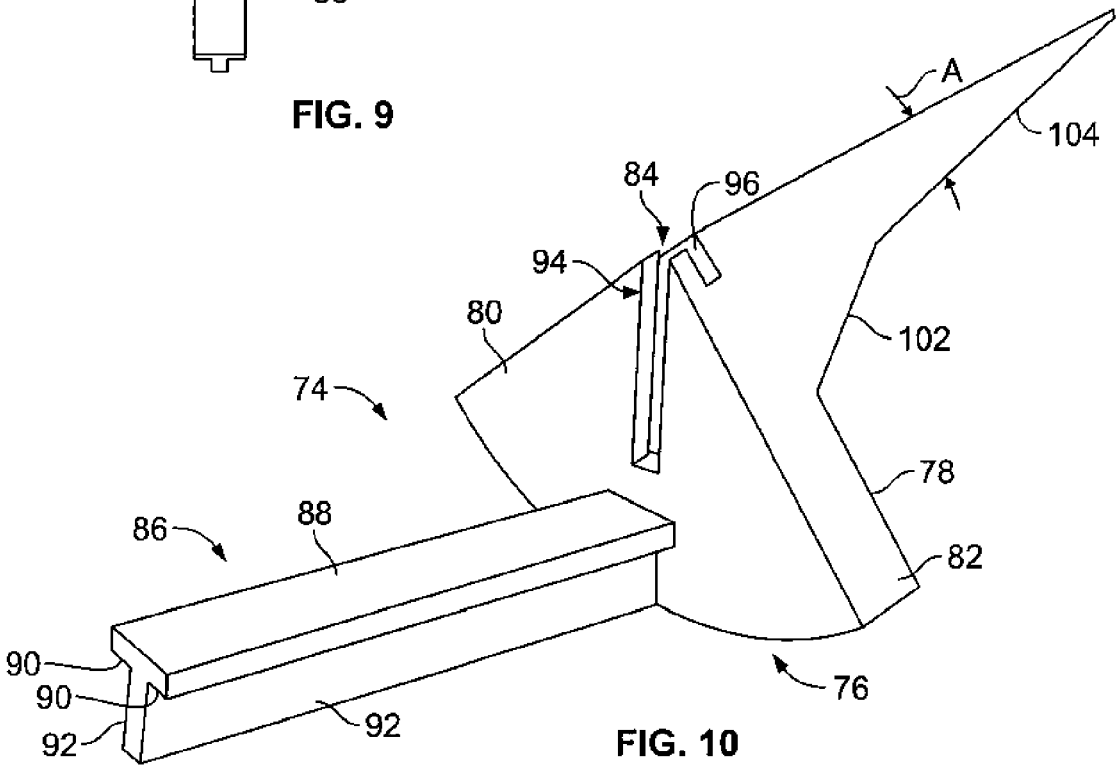
FIG. 10 is a perspective view the prong shown in FIG. 9.

Referring to FIGS. 9 and 10, the device 10 includes four prongs 74. Each prong 74 has a pie-shaped base 76 which has a front surface 78, a rear surface 80 opposite the front surface 78, a side surface 82, and a center 84. A T-shaped rail 86 protrudes from the rear surface 80 of the base 76, and a nose 102 with a beak 104 extends from the front surface 78 of the base 76. It is understood that the rear surface 80 is slightly beveled between the T-shaped rail 86 and the center 84 (this is not visible). More particularly, the thickness of the base 76 is about 3 to 4 thousandths of an inch thinner at its center 84 than it is at its side 82. It is understood that the minimum thickness of the bevel may vary depending on the size of the device 10. The bevel supports the smooth operation of the device 10, which is described hereinbelow.

Each of the rails 86 includes a T-shaped cross-section having an inner surface 88, outer surfaces 90, and side surfaces 92, and it is sized and shaped to slideably fit into a corresponding one of the T-shaped channels 38 of the second section 28 of the body 12. More particularly, the inner surface 88 of the rail 86 is supported by the inner surface 40 of the channel 38, the outer surfaces 90 of the rail 86 are supported by the outer surfaces 42 of the channel 38, and the side surfaces 92 of the rail 86 are supported by the side surfaces 44 of the channel 38.

Each prong 74 includes a slot 94 formed in the base 76 thereof. Each slot 94 includes a T-shaped cross-section having a front surface 96, rear surfaces 98, and side surfaces 100. Each of the slots 94 is sized and shaped to slideably accept a corresponding one of the rails 56 of the head 50 of the shaft 46. More particularly, the front surface 96 of each of the slots 94 supports the front surface 52 of the corresponding rail 56, the rear surfaces 98 of the slot 94 support the rear surfaces 60 of the rail 56, and the side surfaces 100 of the slot 94 support the side surfaces 62 of the rail 56.

Referring to FIG. 10, in an embodiment, each of the beaks 104 includes an angle A which is nominally about 15 degrees. in other embodiments, angle A may be more or less than 15 degrees, depending on the size of device 10. In an embodiment, the beaks 104 may have scoring and/or other frictional features formed thereon (not shown) to assist in stabilizing a seam of the knot while untying the knot. In an embodiment, the geometry of the beaks 104 may be varied according to the type of knot that is being untied.

The components of the device 10 can be made out of materials such as plastic, metal, aluminum or a combination thereof, depending on the application. For instance, many of the components of the device 10 may be fabricated with plastic and may be produced by conventional injection molding procedures. For a larger sized device 10 (e.g., a device which is designed for untying seams in large knots) and because of potential corrosive environments in which the device 10 is employed, many of the components of the device 10 may be fabricated from stainless steel.

Referring to FIG. 6, an angle B defines the angle between each of the inner surfaces 40 of the channels 38 of the second section 28 and the longitudinal axis L. In various embodiments, angle B may be in the range of between about 5 degrees to about 25 degrees, depending on the mechanical advantage that is desired for a particular sized the device 10. For instance, the mechanical advantage decreases with decreasing angle B. More particularly, a smaller angle B produces a smaller axial displacement of the prongs 74 for a given unit distance of travel of the pusher-rod 64. Likewise, a larger angle B produces a larger mechanical advantage. It is understood that a larger mechanical advantage requires the user to provide additional force to move the handgrip 66 in order to overcome the increased frictional forces that are created during the use of the device 10.

Figure 11:
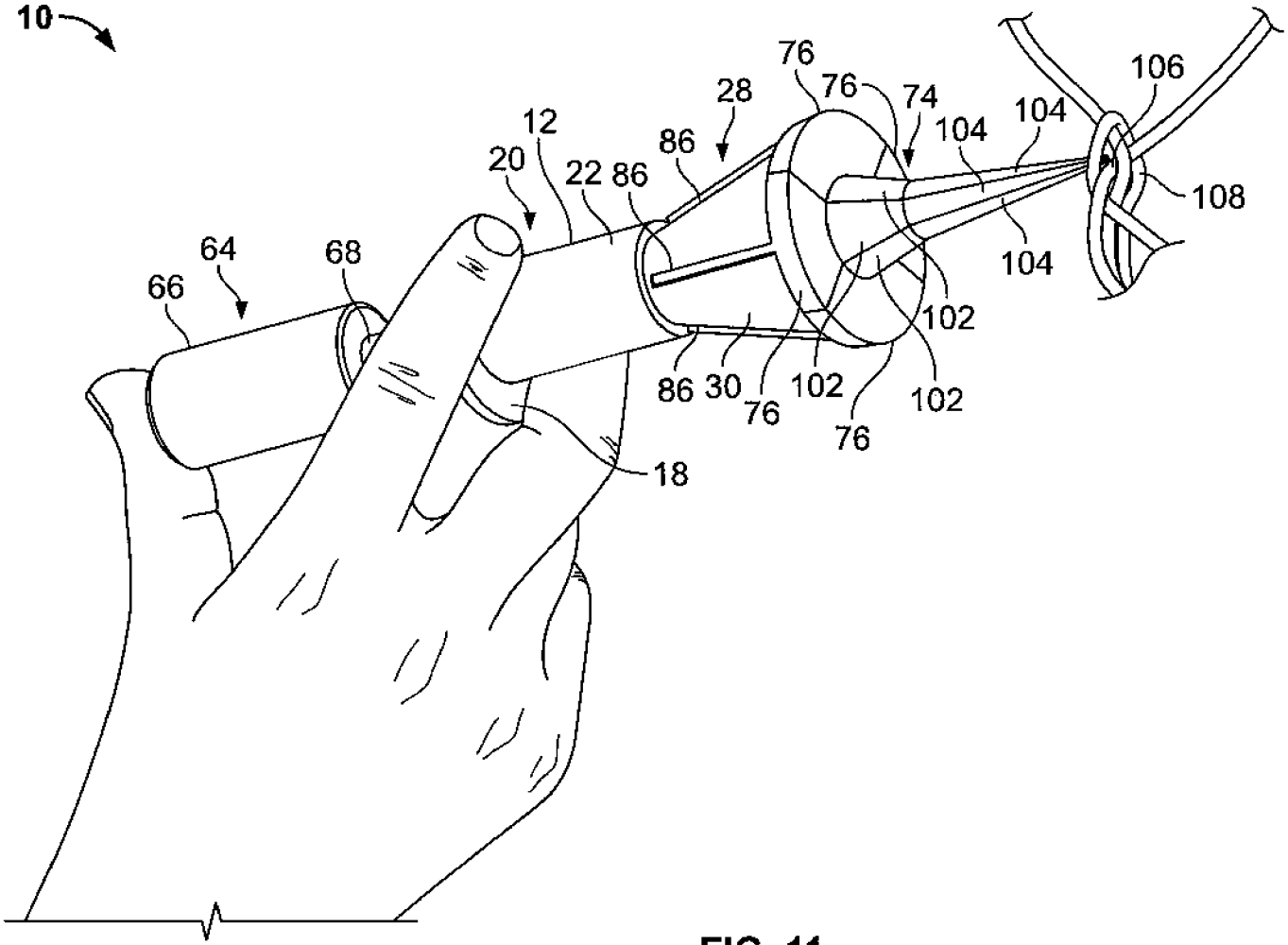
FIG. 11 is a perspective view of the device deployed on a seam of a knot, with the prongs being shown in a closed position.
Figure 12:
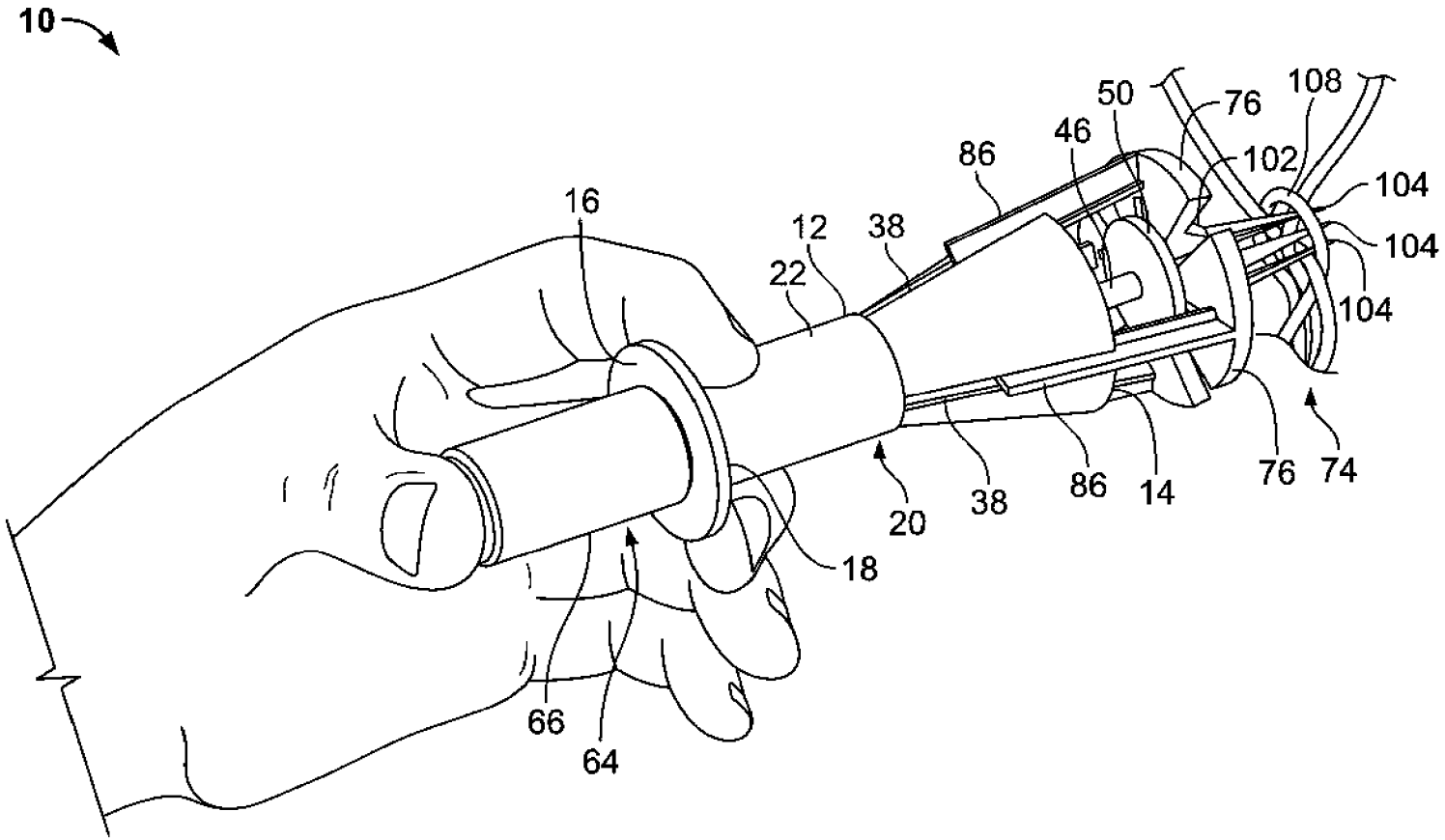
FIG. 12 is a perspective view of the device deployed on the seam of the knot shown in FIG. 11, with the prongs being shown in an open position.

In operation, as shown in FIGS. 11 and 12, a user grasps the handgrip 66 and the outer surface 22 of the first section 20 of the body 12 (using either one or two hands as desired). The user positions the beaks 104 of the prongs 74 initially in the seam 106 of a hard-tied knot 108 of the shoe lacing, and then presses the pusher-rod 66 inwardly into the body 12. As a result, the head 50 of the shaft 46 bears on the rear surfaces 80 of the bases 76 of the prongs 74, and the beaks 104 of the prongs 74 are forced forward into the seam 106 of the knot 108. In an embodiment, the prongs 74 operate in synchronization with one another. Simultaneously, the beaks 104 of the prongs 74 are moved outwardly (i.e., axially away from the longitudinal axis L of the device 10) as a result of the rails 86 of the prongs 74 being slid in the ramped channels 38 of the second section 28. The forward and outward movement of the beaks 104 unties the hard-tied knot seam 106. This is repeated until all of the hard-tied knot seams are loosened.

It should be appreciated that the present invention provides numerous advantages over the prior art discussed above. For instance, the use of the device 10 effortlessly unties hard-tied knot seams, and precludes the use of implements that are not suitable for untying hard-tied knot seams, thereby avoiding any potential harm to the user, the implement, and/or the shoe lacing.

It should be noted that the present invention can have numerous modifications and variations. For instance, the size of the device 10 can be varied according to the size and environment of the knots being untied. Also, the size and shapes of the channels 38 and the corresponding rails 86, as well as the slots 94 and the corresponding rails 56, may vary. In addition, the number of prongs 74 of the device 10 may vary, i.e., the device 10 can include more or less than four of the prongs 74. Also, the device 10 may be motorized, for example, with a switch activated battery powered solenoid (not shown) that may replace the pusher-rod 64.

It will be understood that the embodiment described herein is merely exemplary and that a person skilled in the art may make many variations and modifications without departing from the spirit and scope of the invention. For instance, all such variations and modifications are intended to be included within the scope of the invention as defined in the appended claims.

What is claimed is:

1. A device for loosening and untying knots, comprising:

a body including a front end and a rear end opposite said front end, a first section including a bore, and a second section including a bore and an outer surface, said outer surface of said second section including a plurality of channels formed therein;

a pusher rod positioned slidably within said bore of said first section of said body;

a shaft having a first end and a second end opposite said first end, and a head formed at said second end, said shaft being positioned slidably within said bore of said first section of said body and said bore of said second section of said body, said first end of said shaft being engaged with said pusher rod, said shaft being moveable between a retracted position and an engaged position in response to inward movement of said pusher rod within said body; and a plurality of prongs, each of which includes a base having a front surface, a rear surface opposite said front surface, a nose extending outwardly from said front surface, and a rail extending outwardly from said rear surface, each of said rails of said plurality of prongs being sized and shaped to slidably fit into a corresponding one of said plurality of channels of said second section of said body, said head of said shaft being engaged with said bases of said plurality of prongs, wherein said plurality of prongs is moveable between a retracted position, in which said noses of said plurality of prongs are juxtaposed with one another and adapted to being inserted within a knot, and an expanded position, in which said noses are spaced apart from one another when said shaft is moved to its engaged position, said noses of said plurality of prongs being adapted to loosen and untie the knot when said plurality of prongs is in its expanded position.

2. The device of claim 1, wherein said second section of said body is frusto-conical in shape.

3. The device of claim 2, wherein said head of said shaft includes a front surface having a plurality of rails extending outwardly therefrom, and each of said plurality of prongs includes a slot formed within said base thereof, and wherein each of said slots of said plurality of prongs is sized and shaped to slidably receive a corresponding one of said plurality of rails of said head of said shaft.

4. The device of claim 3, wherein each of said plurality of channels of the body includes a T-shaped cross-section, each of said rails of said plurality of prongs includes a T-shaped cross-section, each of said plurality of rails of said head of said shaft includes a T-shaped cross-section, and each of said slots of said plurality of prongs includes a T-shaped cross-section.

5. The device of claim 4, wherein said rear surface of said base of each of said plurality of prongs is beveled.

6. The device of claim 4, wherein said nose of each of said plurality of prongs includes an angled beak.

7. The device of claim 4, wherein said second section of said body includes a depression formed proximate to said front end of said body, said depression including a surface, and said head of said shaft includes a rear surface opposite said front surface of said head, said rear surface of said head bears against said surface of said depression when said shaft is in its retracted position.

8. The device of claim 7, further comprising a spring housed within said bore of said first section of said body and around said shaft, and wherein said spring includes a first end engaged with said pusher rod, said spring biases said shaft from its engaged position to its retracted position.

9. The device of claim 8, wherein said pusher rod includes a bore having internal threads, and said first end of said shaft includes external threads that threadedly engage said internal threads of said pusher rod.

10. The device of claim 4, wherein said plurality of prongs includes four prongs, said plurality of channels of said second section of said body includes four channels, and said plurality of rails of said head of said shaft includes four rails.

11. The device of claim 10, wherein said rails of said head of said shaft are positioned in a cross-shaped array.

12. The device of claim 10, wherein said body includes a longitudinal axis, and wherein each of said channels of said second section of said body extends at an angle relative to the longitudinal axis.

13. The device of claim 12, wherein the angle is in a range of about 5 degrees to about 25 degrees.

14. The device of claim 1, wherein said pusher rod includes a hand grip.

15. The device of claim 1, wherein said body includes a flange positioned proximate to said rear end thereof.

16. The device of claim 1, wherein said plurality of prongs move in synchronization with one another when moved between its retracted position and expanded position.

* * * * *